United States Patent [19]

Crawley

[11] Patent Number: 4,870,832

[45] Date of Patent: Oct. 3, 1989

[54] POSITIVE VENTILATION COOLING AUGMENTOR

[76] Inventor: Charles R. Crawley, 513 Commagere Blvd., Bay St. Louis, Miss. 39520

[21] Appl. No.: 253,254

[22] Filed: Oct. 3, 1988

[51] Int. Cl.[4] ..... F25D 17/06; F25B 39/04

[52] U.S. Cl. ..... 62/89; 62/428; 62/507; 98/39.1; 98/64; 165/47

[58] Field of Search ..... 165/47, 1; 62/428, 507, 62/89; 98/39.1, 37, 64, 33.1

[56] References Cited

U.S. PATENT DOCUMENTS

| | | | |
|---|---|---|---|
| 2,240,951 | 5/1941 | Hamjy | 98/31 |
| 2,669,393 | 2/1954 | Schleicha | 98/31 |
| 2,700,331 | 1/1955 | Miller | 98/31.5 |
| 2,722,107 | 11/1955 | Gay | 62/428 |
| 2,817,217 | 12/1957 | Winkler et al. | 62/428 |
| 3,247,895 | 4/1966 | Phillips, Jr. | 98/31 |
| 3,727,538 | 4/1973 | Jacobson, Jr. | 98/31 |
| 3,905,548 | 9/1975 | Brodie | 98/31 |
| 4,254,822 | 3/1981 | Geier | 165/47 |
| 4,351,163 | 9/1982 | Johannsen | 62/428 |
| 4,779,671 | 10/1988 | Dolison | 62/428 |

FOREIGN PATENT DOCUMENTS

| | | | |
|---|---|---|---|
| 0624384 | 1/1936 | Fed. Rep. of Germany | 62/507 |
| 57-131948 | 8/1982 | Japan | 98/31 |
| 59-13838 | 1/1984 | Japan | 98/39.1 |
| 0759803 | 9/1980 | U.S.S.R. | 98/31 |
| 1337396 | 11/1973 | United Kingdom | 98/31 |

*Primary Examiner*—John Ford

*Attorney, Agent, or Firm*—Alexander F. Norcross

[57] ABSTRACT

The apparatus comprises a large, open ended air collector attachment above an external heat exchanger of a standard residential air conditioner, which ducts the exhausted heat exchanger air flow into the attic of a building through a substantially vertically ascending air flow tube. The combination of the fan exhaust pressure together with adiabatic expansion of the warm air rising in the air tube produces sufficient air flow within the attic to pressure ventilate and thereby cool an average household attic, by displacing air trapped within the attic. This, in turn, reduces the heat load into the air-conditioned spaces of the house, by reducing the heat radiated from the attic spaces downward through the ceiling of the housing.

5 Claims, 4 Drawing Sheets

POSITIVE VENTILATION COOLING AUGMENTOR

BACKGROUND OF THE INVENTION

This invention relates to the field of air conditioning and heating exchanger interflow for aiding the heating and cooling of a building.

A number of patents disclose various methods of circulating the waste heat from a heater for the purpose of more efficient use of heat in a building.

Soviet Patent 759,803 discloses the use of porous inserts for ventilators within a building so as to remove the heat from air exhausted from the building and add it to external air being brought in.

British Pat. No. 1,337,396 discloses, incident to a heating system which involves the use of extraordinarily long runs of ducting to heat the seats in a stadium, using the radiant lost heat from the ducting as part of the overall heating effect.

U.S. Pat. No. 3,247,895 to Phillips discloses ducting hot or cold air through a building by sealing the inner space between the walls and the floors and utilizing the resulting air space as an air duct. A related concept can be shown in U.S. Pat. No. 2,240,951 to Hamjy and U.S. Pat. No. 3,905,548 to Brodie. Japanese Pat. No. 57-131948 discloses a variation of this concept, using a rising duct pipe with a thermostatically activated ventilator system to inject air into the attic area of a house, displacing the warmer air into the walls, so as to more effectively conduct the heat of the attic to the rooms of the building.

U.S. Pat. No. 3,727,538 to Jacobson and U.S. Pat. No. 2,669,393 to Schleicher are alternate forms of heating systems.

In addition to the Japanese patent noted above, U.S. Pat. No. 2,700,331 to Miller discloses the use of the entrapped heated air within an attic space in a dual purpose air circulating unit, substituting for the standard ventilator wind turbine, which can either exhaust the hot air for a cooling effect or alternatively, blow the hot air in a downward direction too more evenly distribute the heat if a heating effect is desired.

SUMMARY OF THE INVENTION

This invention relates to an apparatus for utilizing the air flow from an external heat exchanger of a standard household air conditioning unit to reduce the total heat loading on a building in the summer.

In its simplest forms, the apparatus comprises a large, open ended air collector attachment above an external heat exchanger of a standard residential air conditioner, which ducts the exhausted heat exchanger air flow into the attic of a building through a substantially vertically ascending air flow tube.

In use, the device takes advantage of the fact that each standard air-conditioning unit has a vertical exhaust fan driving hot air from the heat exchanger. Part of this hot air flow is captured within an air collector and directed into an ascending air tube. The continuous ascending air tube preserves the heat induced air flow; the flow rate in the air tube is enhanced through a chimney draft effect (adiabatic expansion lifting) since the exhaust air from the heat exchanger of the air conditioner is above ambient temperature.

Intuitively, pumping hot air into the attic of the building would seem to be counterproductive for cooling. In fact, it has been determined through experimentation that the combination of the fan exhaust pressure together with adiabatic expansion of the air rising in the air tube produces sufficient air flow within the attic to pressure ventilate and further cool an average household attic.

It has been determined through experimentation that air trapped within a building attic in a summertime environment is heated to a temperature greater than the air exhausted from the heat exchanger of an average household air-conditioning unit. Thus, this exchange of air, under positive pressure, significantly lowers the overall air temperature within the attic.

This, in turn, reduces the heat load into the air-conditioned spaces of the house, by reducing the heat radiated from the attic spaces downward through the ceiling of the house.

The apparatus provides more efficiency in ventilating the attic than a wind turbine or power driven attic fan, at a significant saving in energy costs because of its re-use and recycling of otherwise waste heat and exhaust air from the air-conditioner.

It is therefore, an object of this invention to disclose an apparatus for addition to a standard air conditioning installation which reduces the total heat loading on a building.

It is a further object of this invention to disclose an apparatus for use in conjunction with a standard air conditioner installation which increases the efficiency of cooling of the overall air conditioning system.

It is a further object of this invention to disclose an apparatus which reduces substantially the temperature loading of a building which is air conditioned.

These and other objects of the invention may be more clearly seen from the detailed description of the preferred embodiment which follows:

DETAILED DESCRIPTION OF THE PREFERRED EMBODIMENT

Figure 5:
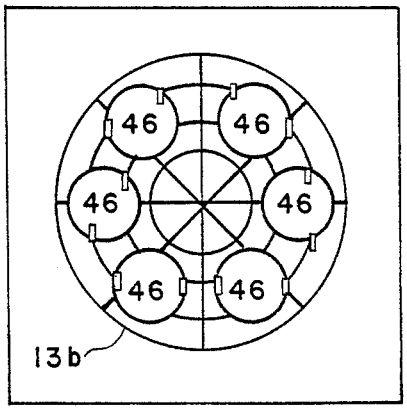
FIG. 5 depicts an alternate form of collector.
Figure 6:
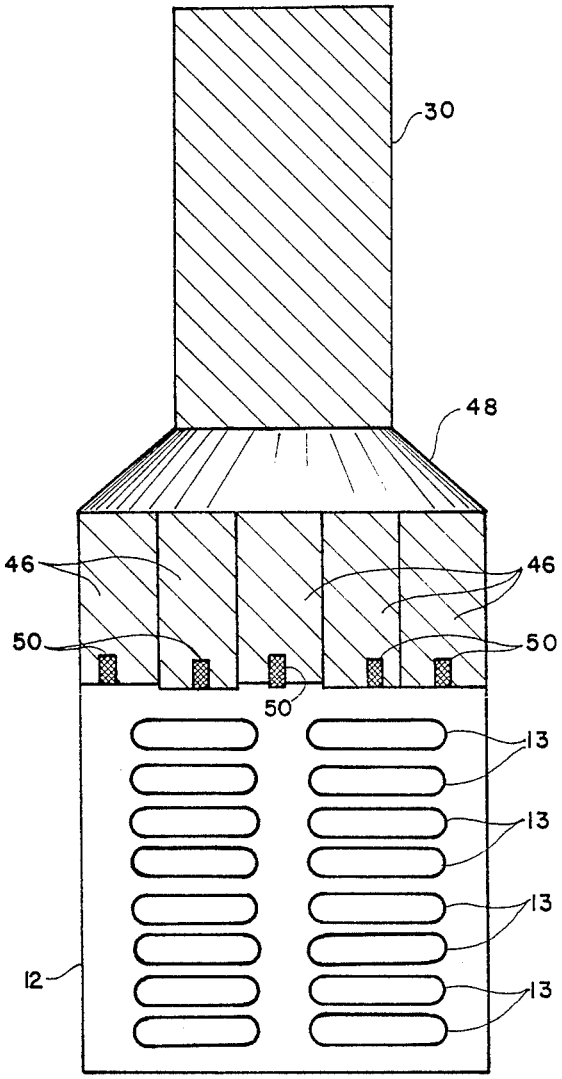
FIG. 6 is a section view showing the alternate form of collection covering heat exchanger exhaust.

Referring to the figures, FIGS. 1–4 show an initial prototype version of the invention in question using a first form of collector and FIGS. 5–6 shows a second, preferred form of collector of the invention.

Figure 2:
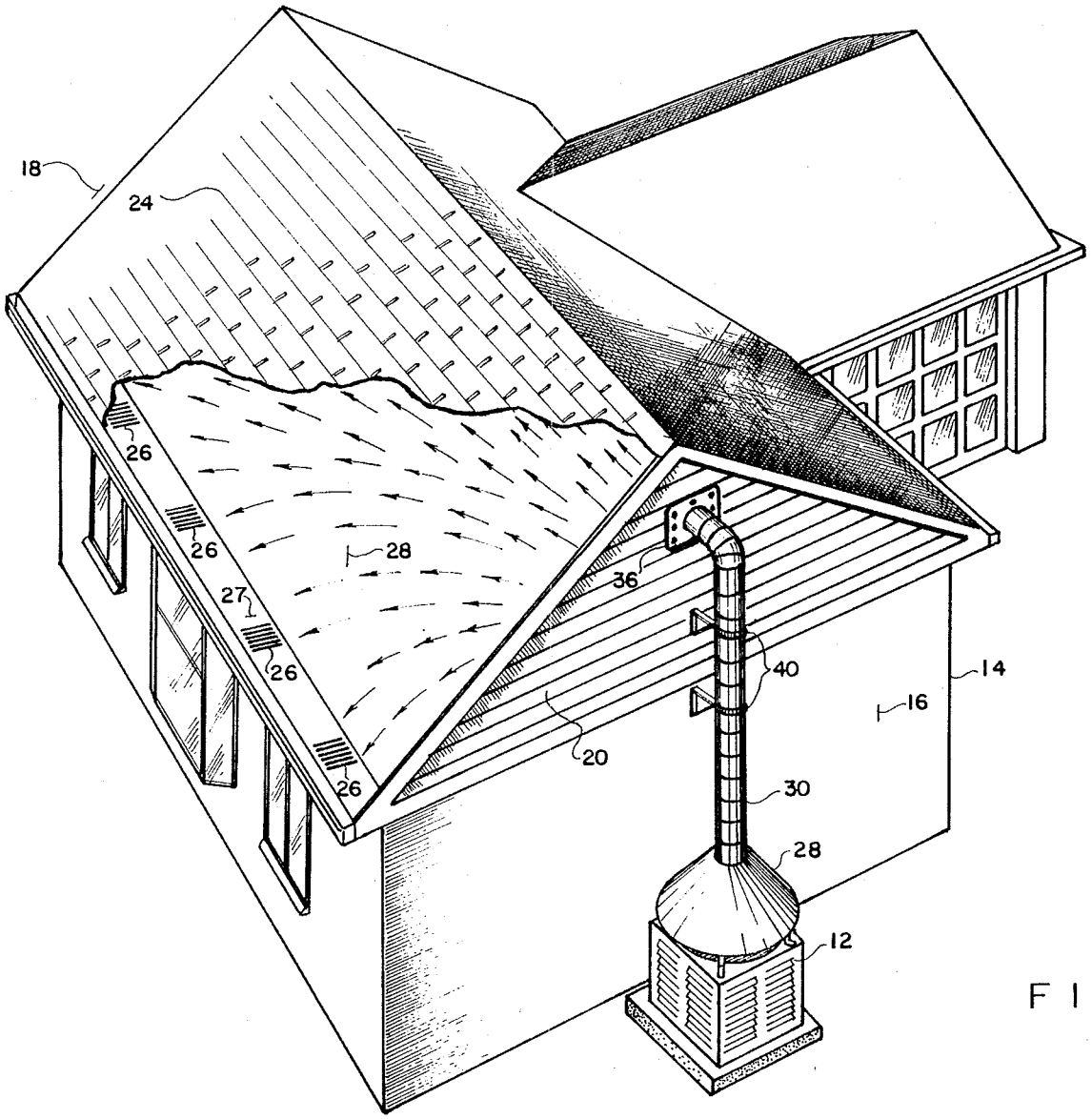
FIG. 2 is a view of an embodiment depicting air flows.
Figure 4:
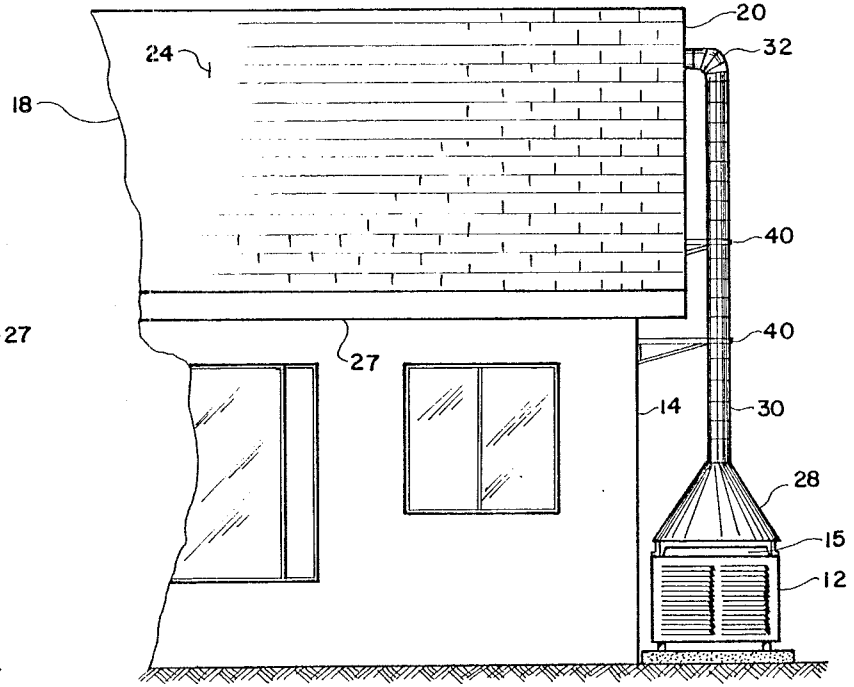
FIG. 4 depicts a side view of the invention.
Figure 3:
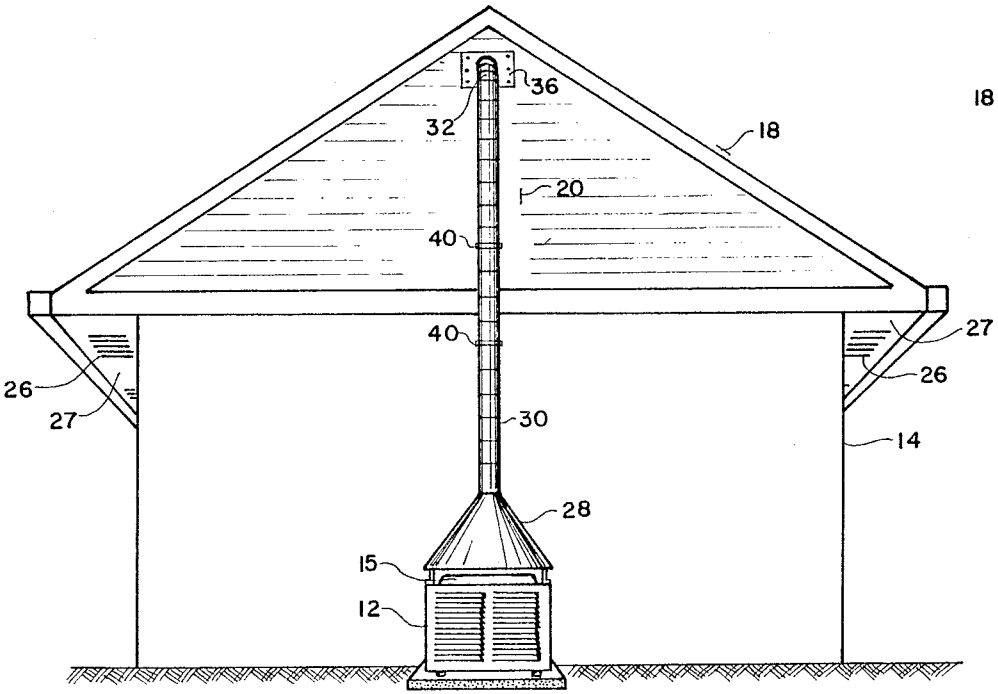
FIG. 3 depicts an end view of the invention.

Looking at FIG. 2, the invention is installed upon a standard air conditioner 10 within a building 14. While a house is depicted, the invention is clearly applicable to any building having an air space between its roof and upper ceiling. Such an air conditioning system has an external heat exchange 12 of standard construction consisting of heat exchanger coils and a vertically exhausting fan for drawing air in from the heat exchanger louvers 13 and exhausting the heated air through the top 15 of the heat exchanger. This air is normally exhausted to the outside and provides the sink for dumping waste heat extracted by air conditioner 10 from within building 14.

An air conditioned building 14, as is known, is enclosed with external insulating walls 16, and for typical buildings is provided with an attic 18, above the living spaces of the building and defined by the attic end walls 20, the building roof 24 and the inner ceiling 25 of the building; this defines an attic air space 22 which is normally intended to be an insulating air space within a building.

Thus, the ceiling 25 will typically be insulated with fiberglass battens or the like to thermally isolate the attic from the interior spaces of building 14.

However, it is a characteristic of building roofs 24 that, in order to provide for a long term weather resistant covering, they are usually covered with asphalt loaded shingles, and such shingles are generally of a darker color, readily heated by solar heat. As a result, attic air space 22, especially during the summer months, is typically heated to quite a high temperature. The air within the attic only slightly flows through attic vents 26, provided along the eaves 27. While such vents 26 provide for some circulation of air, they are primarily intended for the removal of humidity and the prevention of rot; they do not provide air circulation adequate to lower the temperature within the attic air space 22.

It is this higher attic air temperature that leads to the universal practice of insulating the area within the ceiling of the attic so as to attempt to thermally isolate an attic air space 22 from the rest of the building 14.

Figure 1:
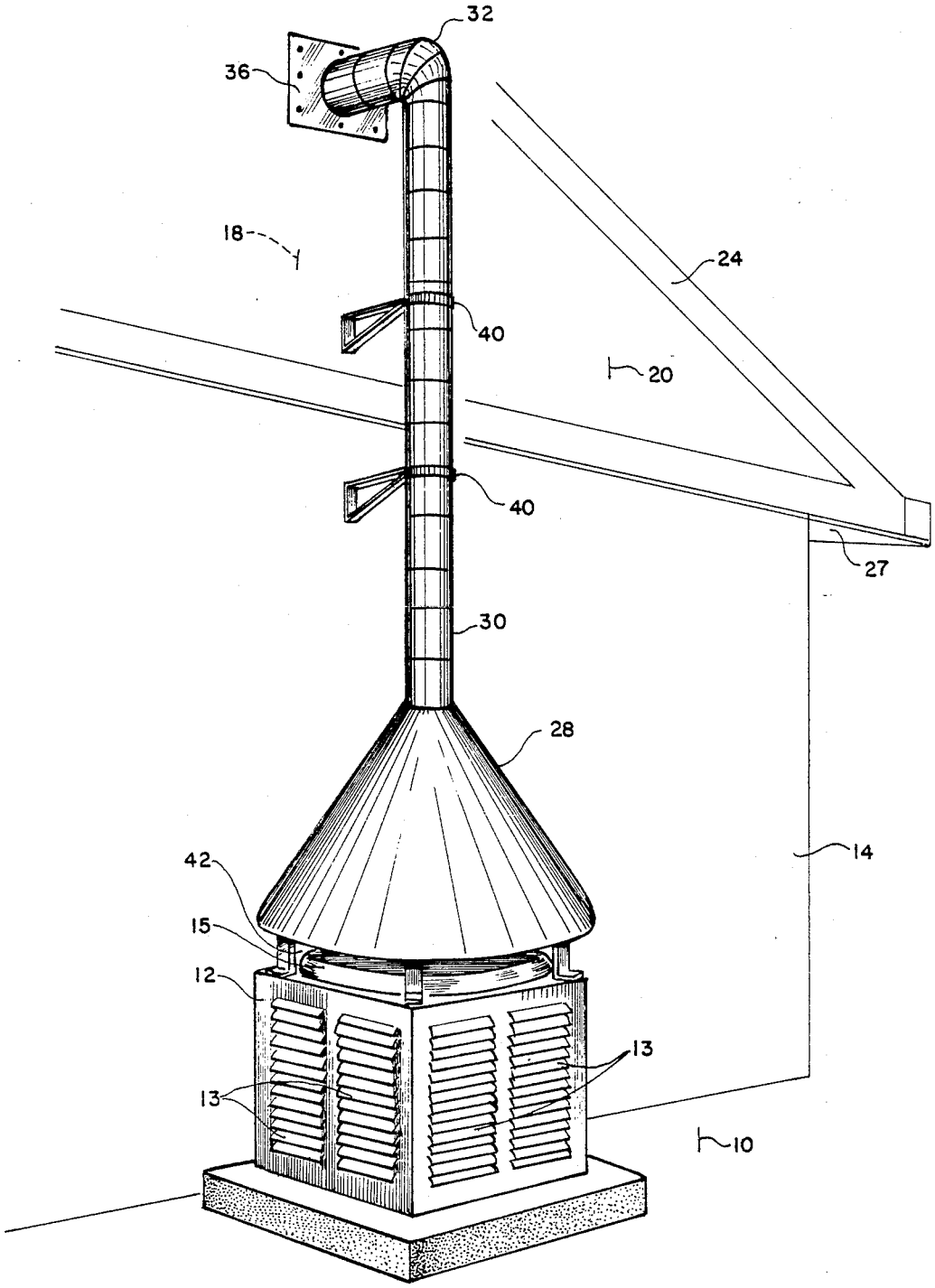
FIG. 1 is a view of an embodiment of the invention installed on a building.

The invention, as shown most clearly in FIG. 1, comprises a thermal air collector section 28 vertically disposed above the exterior air conditioner heat exchanger 12 so as to capture and redirect a substantial portion of fraction of the heated air flow from heat exchanger exit 15. Collector 28 is then internally connected to a hollow vertical chimney section 30, passing vertically up alongside the external wall 16 of building 14 to a position adjacent the attic end or sidewall 20. Vertical chimney section 30 then interconnects into attic air space 22, in the embodiment shown through an elbow section 32 of constant internal diameter and a through connection 36 providing a sealed open air passage through attic end wall 20 into attic air space 22.

It should be obvious that vertical chimney section 30 could equally well be made of a flexible tubing, and in the preferred embodiment of the invention the entire vertical vent section comprising vertical chimney section 30, elbow bend 32 connecting the connector 28 to the through connection 36 is comprised of a uniform piece of internally spirally reinforced flexible plastic hose, in construction much like a flexible air duct, but of a stouter and more light resistant plastic, so as to resist the weathering effects of light and external exposure. Where such a hose is utilized, vertical chimney supports 40 are periodically provided to affix the vertical chimney section to the external wall 16 of the building so as to prevent vibration and movement. In this document the vertical chimney section 30 is also referred to as an air tube.

In practice, it is discovered that so long as a portion of the heated air emitted by external heat exchanger 12 can be captured by collector 28, that the chimney effect provided by the elongate vertical passage of air tube 30 provides a positive air pressure into the attic air space 22 and results in the venting, through the air pressure differential of a substantial portion of the air within attic air space 22 through the attic air vents 26. Even though the air emitted by an air conditioner external heat exchanger 12 is warmer than the ambient air, it has been discovered that after rising it is cooler than air typically trapped within an attic air space and heated over the course of the day through solar radiation impingent upon a building roof 24.

Further, the constantly circulating air, together with the loss of energy as the air conditioner external air rises, reduces the temperature in the attic by a noticeable margin, significantly lowering the air conditioner loads for cooling the rest of building 14. This occurs without any additional expenditure of energy on the part of air conditioner 10, as collector 28 is either spaced by offset space 42 or, in the alternative version, is provided with bypass spaces 44, thus eliminating any substantial back pressure upon the external heat exchanger 12 by allowing only a portion or fraction of the air exhausted from the air conditioner external heat exchange to enter the collector 28.

Thus, the invention essentially captures the heat from the air conditioner and utilizes it, without additional expenditure of energy to reduce the overall heat load that must be removed from building 14.

In a preferred embodiment of collector 28, one that is felt to be more easily reproduced and installed, collector 28 is made of a plurality, preferably six, of flexible connector sections 46, each of which is comprised of the same flexible spirally reinforced tubular conduit as is air tube or vertical chimney section 30. Each of these flexible collector sections 46 is connected in an upper end through manifold 48 to air tube 30; the lower end of each of collector sections 46 are directly clipped to the found screen baskets or louvers **13*b* typically found on a heat exchanger air exit 15 for typical external heat exchanger 12. These clips are easily installed and prevents movement of the collector sections 46. In order to avoid choking or excessive back pressure upon the fan within external heat exchanger 12, the typical six collector sections 46, are circular leaving open collector bypass air spaces 44 between them for bypassing a portion of the exhausted air from external heat exchanger 12**.

The clips 50 may be of any typical metal clip, and are typically a two section spring clip affixed to the lower end of collector section 46 and clamped to the wire frame (not shown) found at the exit of a typical heat exchanger 15.

It can thus be seen that the invention has a number of embodiments but that the basic mechanical structure collects and raises the vented air from an external air conditioner heat exchanger through a substantial vertical chimney, venting it into the attic space of a building. The invention is, therefore, that wider range of equivalents as are implicit in the claims.

I claim:

1. A process for increasing the efficiency of air conditioning, in a building having an air conditioning system with a heat exchange external to the building and having an attic thereof comprising:

a. diverting a portion of the heated air emitted by said heat exchanger;

b. ducting said diverted heated air through a substantially vertical flow path creating an adiabatic rising effect therein;

c. ducting said heated air from said vertical flow path into the attic of said building.

2. An apparatus for increasing the efficiency of air conditioning of a building having an attic and an air conditioning system with a external heat exchanger, to the building comprising:

a. means, above said heat exchanger, for diverting the flow of a fraction of air exhausted from said heat exchanger;

b. said means being connected for flow of said diverted air to a vertically ascending air tube;

c. said vertically asscending air tube being connected for the continuing flow of said diverted air into the attic of said building.

3. The apparatus as described in claim 2 above wherein said means for diverting air further comprise:

a. a plurality of flexible air tube sections;

b. each said air tube section having a lower end affixed to an air exhaust side of said heat exchanger;

c. each said air tube section having an upper end connected for flow of diverted air to a connecting manifold;

d. said manifold being connected for flow of air to said vertically ascending air tube.

4. The apparatus of claim 2 above, wherein said vertically ascending air tube comprises an elongate, flexible hollow plastic tube having a spiral reinforcing means therein.

5. The apparatus of claim 3 above wherein each said air tube section comprises an elongate hollow plastic tube having a spiral wall reinforcing means therein.

* * * * *